US006408594B1

(12) United States Patent
Porter

(10) Patent No.: US 6,408,594 B1
(45) Date of Patent: Jun. 25, 2002

(54) REINFORCED STRUCTURAL INSULATED PANELS WITH PLASTIC IMPREGNATED PAPER FACINGS

(76) Inventor: William H. Porter, P.O. Box 249, Saugatuck, MI (US) 49453

( * ) Notice: Subject to any disclaimer, the term of this patent is extended or adjusted under 35 U.S.C. 154(b) by 0 days.

(21) Appl. No.: 09/334,233

(22) Filed: Jun. 16, 1999

(51) Int. Cl.[7] ..... E04C 2/34

(52) U.S. Cl. ..... 52/794.1; 52/220.1; 52/268; 52/270; 52/309.7; 52/309.11; 52/586.1

(58) Field of Search ..... 52/236.7, 262, 52/265, 267, 268, 269, 270, 275–279, 437–439, 309.7, 309.11, 309.14, 309.16, 574, 586.1, 590.2, 592.2, 220.1, 20.3

(56) References Cited

U.S. PATENT DOCUMENTS

| | | | | |
|---|---|---|---|---|
| 919,057 | A | | 4/1909 | Moore |
| 1,250,594 | A | | 12/1917 | Knapp |
| 2,111,922 | A | | 3/1938 | Borkenstein |
| 2,875,478 | A | | 3/1959 | Andre |
| 3,557,840 | A | | 1/1971 | Maybee |
| 3,654,053 | A | | 4/1972 | Toedter |
| 3,731,449 | A | | 5/1973 | Kephart, Jr. |
| 3,911,554 | A | | 10/1975 | Ford |
| 4,024,684 | A | | 5/1977 | Holmgren |
| 4,037,377 | A | | 7/1977 | Howell et al. |
| 4,051,641 | A | | 10/1977 | Elliott |
| 4,068,437 | A | | 1/1978 | Byxbe et al. |
| 4,147,004 | A | | 4/1979 | Day et al. |
| 4,169,688 | A | | 10/1979 | Toshio |
| 4,170,859 | A | | 10/1979 | Counihan |
| 4,402,170 | A | | 9/1983 | Seidner |
| 4,430,833 | A | | 2/1984 | Balzer et al. |
| 4,443,988 | A | | 4/1984 | Coutu, Sr. |
| 4,471,591 | A | | 9/1984 | Jamison |
| 4,671,038 | A | | 6/1987 | Porter |
| 4,704,837 | A | | 11/1987 | Menchetti et al. |
| 4,712,352 | A | * | 12/1987 | Low ..... 52/809 |
| 4,726,973 | A | | 2/1988 | Thompson |
| 4,765,105 | A | | 8/1988 | Tissington et al. |
| 4,786,547 | A | | 11/1988 | St-Michel |
| 4,856,244 | A | | 8/1989 | Clapp |
| 4,865,912 | A | | 9/1989 | Mitsumata |
| 4,932,171 | A | | 6/1990 | Beattie |
| 5,058,333 | A | | 10/1991 | Schwartz |
| 5,062,250 | A | | 11/1991 | Buzzella |

(List continued on next page.)

*Primary Examiner*—Carl D. Friedman
*Assistant Examiner*—Yvonne M. Horton
(74) *Attorney, Agent, or Firm*—Emrich & Dithmar

(57) ABSTRACT

A structural insulated panel for building construction includes a planar, rigid insulating core such as of lightweight plastic foam having opposed surfaces to which are bonded respective plastic impregnated paper (PIP) sheets. Disposed symmetrically either on the inner surfaces of the PIP sheets, and thus within the panel's insulating foam core, or on the outer surfaces of the PIP sheets are spaced reinforcing strips. The reinforcing strips may be flat or formed, such as in the shape of a channel, may be of metal, gypsum composites, or wood, and are provided with an adhesive coating for bonding to the insulating foam core and a PIP sheet. The spaced metal strips increase the panel's bending strength and serve as an attachment base for internal and external finished faces, while the PIP sheets provide the panel with high tensile strength. The adhesive coating on the metal reinforcing strips further increases panel strength. The metal strips may also be provided with an outer gypsum coating to protect the metal strip from heat and/or fire. The panels may be used in walls, roofs or floors. When used in a wall, top and bottom U-shaped metal channels may be respectively positioned on upper and lower edges of the panel and attached to respective upper and lower edges of the reinforcing strips within the panel by conventional means such as screws. Adjacent panels may be joined by metal strips attached such as by screws or clips to the panels' top and bottom edge channels.

39 Claims, 5 Drawing Sheets

U.S. PATENT DOCUMENTS 5,081,810 A 1/1992 Emmert
5,140,086 A 8/1992 Hunter et al.
5,345,738 A 9/1994 Dimakis
5,428,929 A 7/1995 Reese
5,497,589 A 3/1996 Porter
5,628,158 A 5/1997 Porter
5,638,651 A 6/1997 Ford
5,743,056 A * 4/1998 Balla-Goddard et al. 52/309.11
5,771,645 A * 6/1998 Porter ..... 52/220.1
5,815,989 A * 10/1998 Bennenk et al. ..... 52/80.1
5,842,314 A 12/1998 Porter
5,950,389 A 9/1999 Porter
5,953,883 A 9/1999 Ojala
6,041,562 A * 3/2000 Martella et al. ..... 52/236.7
6,136,408 A * 10/2000 Radcliffe et al. ..... 428/107
6,205,729 B1 * 3/2001 Porter ..... 52/309.7
6,209,284 B1 * 4/2001 Porter ..... 52/794.1
6,269,608 B1 * 8/2001 Porter ..... 52/794.1
6,308,491 B1 * 10/2001 Porter ..... 52/794.1

* cited by examiner

REINFORCED STRUCTURAL INSULATED PANELS WITH PLASTIC IMPREGNATED PAPER FACINGS

FIELD OF THE INVENTION

This invention relates generally to structural insulated panels such as used in building construction and is particularly directed to a rigid flat panel having an insulating core, first and second opposed outer facings having high tensile strength, and reinforcing strips attached to either the inner or outer surface of one or both of the panel's facings.

BACKGROUND OF THE INVENTION

Lumber stick construction commonly used in the construction of most homes and small to medium sized structures employs 2X dimensional structural lumber members and nails for joining the lumber members. The stick built approach requires assembly and joining of the lumber members by hand and is thus manpower intensive. In addition, the lumber products used are seldom straight, warp with moisture, creep under a load, and are of inconsistent quality. Moreover, lumber cannot withstand high point loading and is thus of limited structural strength. Finally, 2X dimensional structural lumber members form thermal bridges in exterior walls and roofs and thus are not energy efficient.

The present invention addresses the aforementioned limitations of the prior art by providing a metal reinforced structural insulated panel having a lightweight insulating core and first and second opposed outer facings attached to the core and comprised of plastic impregnated paper for high tensile strength. The panel incorporates reinforcing strips such as of either metal or wood bonded to inner or outer surfaces of the outer facings to accommodate large axial, transverse and compression loads.

OBJECTS AND SUMMARY OF THE INVENTION

Accordingly, it is an object of the present invention to provide a structural insulated panel capable of withstanding large tensile, bending, compression, axial and racking loads which is of simple construction and easy to install.

It is another object of the present invention to provide a structural insulated panel having an insulating foam core with high tensile strength outer facings and wood or metal reinforcing strips attached to either an outer surface of a facing or to an inner surface of a facing and the insulating foam core to accommodate large axial, transverse and compression loads.

Yet another object of the present invention is to provide a structural insulated panel with internal reinforcing strips and upper and lower metal edge caps connected respectively to the upper and lower ends of the reinforcing strips for facilitating attachment of the panel to a foundation or floor and a ceiling or roof.

This invention contemplates a reinforced, insulated structural panel comprising a generally flat insulating core having first and second opposed sides; first and second sheets of plastic impregnated paper respectively disposed on the first and second sides of the insulating core for providing the panel with high tensile strength; first and second elongated, linear structural members respectively disposed in contact with the first and second sheets of plastic impregnated paper and extending substantially the entire length of the panel for increasing the bending strength of the panel; and adhesive means disposed on the first and second structural members for respectively bonding the first and second structural members to said first and second sheets of plastic impregnated paper.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENTS

Figure 1:
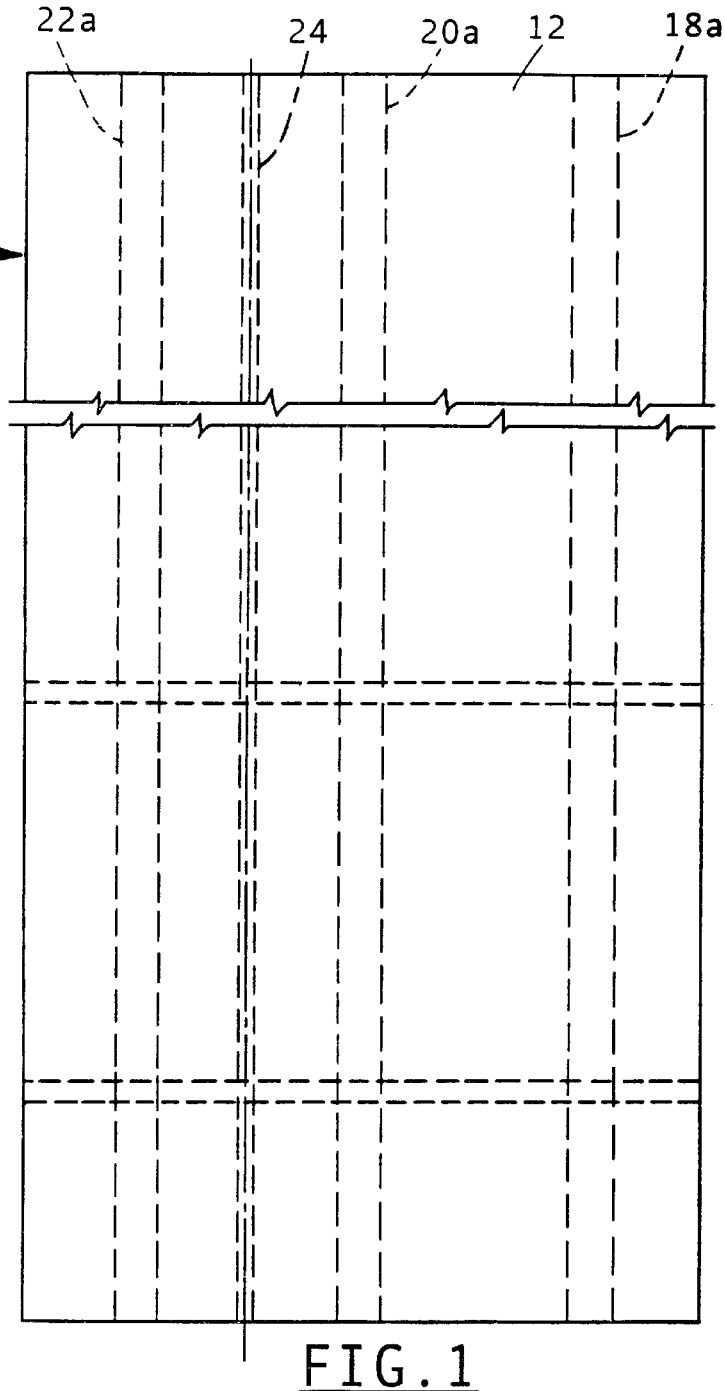
FIG. 1 is a plan view shown partially in phantom of a metal reinforced structural insulated panel with plastic impregnated facings in accordance with the principles of the present invention.
Figure 3:
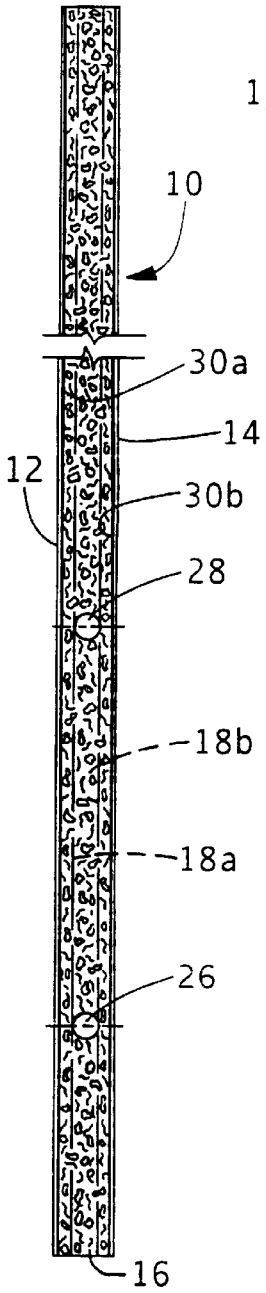
FIG. 3 is a side elevation view shown partially in phantom of the metal reinforced structural insulated panel shown in FIGS. 1 and 2.
Figure 2:
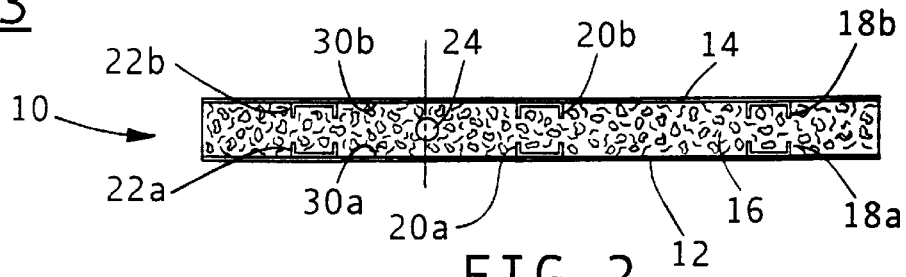
FIG. 2 is a top plan view of the metal reinforced structural insulated panel of FIG. 1.

Referring to FIGS. 1, 2 and 3, there are respectively shown front elevation, top planar and side elevation views of a metal reinforced structural insulated panel 10 in accordance with one embodiment of the present invention. FIGS. 1 and 3 are shown partially in phantom to illustrate internal components within the structural insulated panel 10.

Structural panel 10 includes an inner, rigid insulating core 16 preferably comprised of a plastic foam such as of expanded polystyrene or urethane. The insulating core 16 may also be made from an agricultural product such as strawboard. Structural panel 10 further includes first and second outer facings 12 and 14 attached to respective opposed surfaces of the panel's insulating core 16. Each of the first and second outer facings 12,14 is preferably comprised of paper or box board impregnated with urethane or polyisocyanurate plastic. This plastic impregnated paper is commercially available from Weyerhauser and is sold under the trade nare of P-CELL. The plastic impregnated paper sheet facings 12,14 offer several advantages. For example, the plastic impregnated paper sheets serve as a vapor barrier near the outer and inner surfaces of an exterior wall or roof deck to prevent moisture from entering the insulating core 16 of the structural panel 10 from either the outside environment or from an inside room of a building structure. Moisture passing through the structural insulated panel 10 may result in a loss of moisture from the interior of the building structure, reducing the comfort level of occupants of the building structure. The introduction of moisture into the interior of the structural panel 10 will also eventually result in degradation of the panel structure. The plastic impregnated paper composition of the first and second outer facings 12,14 also substantially increases the tensile strength of the structural insulated panel 10. The plastic impregnated paper sheets attached to the panel's insulating core 16 enable the panel to withstand large transverse loads when the plastic impregnated paper sheet/outer facing side of the panel is in tension. Adhesive layers 30*a* and 30*b* respectively disposed on inner surfaces of the first and second outer facings 12,14 securely attach the plastic impregnated paper sheet to the panel's insulating core 16. The adhesive layers 30*a*,30*b* may be of conventional composition such as urethane cement, glue or an epoxy resin.

Disposed within the panel's insulating core 16 and in contact with and bonded to the inner surfaces of the first and second outer facings 12,14 are a plurality of spaced metal reinforcing channels. Thus, metal reinforcing channels 18*a*, 20*b* and 22a are disposed within the panel's insulating core 16 and are bonded to the inner surface of the panel's first outer facing 12. Similarly, metal reinforcing channels 18*b*, 20*b* and 22*b* are disposed within the panel's insulating core 16 and are bonded to the inner surface of the panel's second outer facing 14. While the metal reinforcing members are shown having a shaped channel form, each of these metal reinforcing members may equally as well be flat in cross section as described below. Each of the metal reinforcing channels is formed from sheet metal such as steel or aluminum. The metal reinforcing channels substantially increase the bending strength of the panel particularly along its length. Insulated structural panels incorporating metal reinforcing channels in accordance with the present invention exhibit an increase in bending strength of at least 40% over non-reinforced structural panels. Structural panel 10 further includes a plurality of electrical chases 24, 26 and 28 extending through the panel's insulating core 16 for receiving electrical wiring (not shown for simplicity). The first, second and third electrical chases 24, 26 and 28 are formed in the panel's insulating core 16 by conventional means such as described in applicant's U.S. Pat. No. 5,771,645.

Figure 1A:
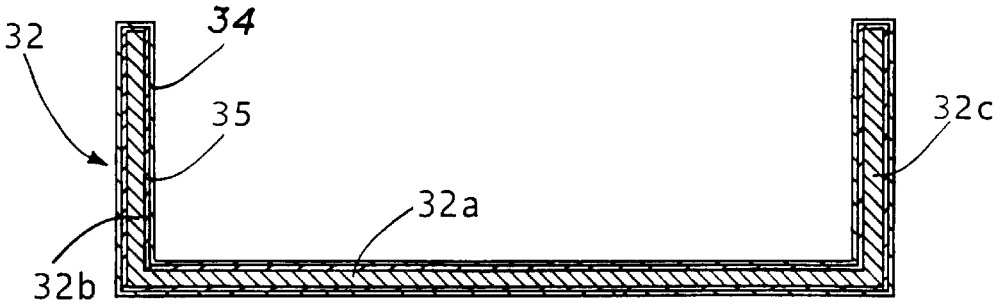
FIG. 1*a* is a transverse sectional view of one embodiment of a metal reinforcing member used in the structural insulated panel of the present invention.

Referring to FIG. 1*a*, there is shown a traverse sectional view of a metal reinforcing channel 32 such as used in the disclosed embodiment of the present invention. Metal reinforcing channel 32 includes a center section 32*a* and first and second end sections 32*b* and 32*c*. Disposed on the surface of the metal reinforcing channel 32 is a gypsum layer 35 to protect the metal member from excessive heat such as from a fire. Disposed on the gypsum layer 35 is an adhesive coating 34 for bonding to the panel's insulating foam core and one of its plastic impregnated paper outer facings. Secure bonding between these components of the structural insulated panel substantially increase the panel's strength. Any conventional adhesive coating 34 may be used on the surface of the metal reinforcing channel 32 such as urethane or epoxy cement, glue or a mastic coating.

Figure 4:
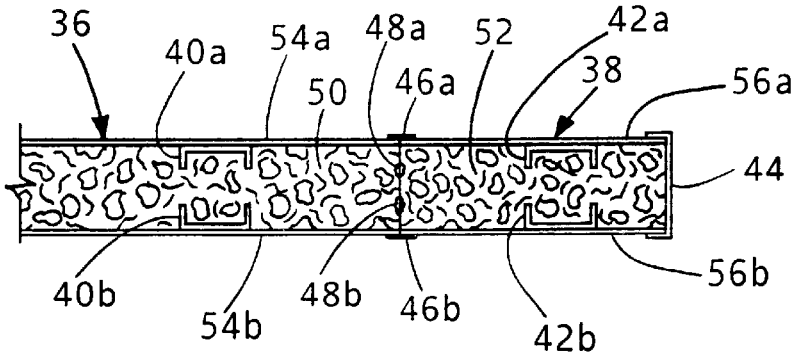
FIG. 4 is a partial top plan view of a pair of metal reinforced structural insulated panels which are connected together in accordance with another aspect of the present invention.

Referring to FIG. 4, there is shown a top plan view of an arrangement for connecting first and second structural insulated panels 36 and 38 in accordance with another aspect of the present invention. As in the previously described embodiment, the first structural insulated panel 36 includes an insulating plastic foam core 50 and first and second outer plastic impregnated paper facings 54*a* and 54*b* attached to opposed surfaces of the foam core. Disposed within and bonded to the foam core 50 as well as to the first and second outer facings 54*a*,54*b* are first and second metal reinforcing channels 40*a* and 40*b*, respectively. Similarly, the second structural insulated panel 38 includes an insulating plastic foam core 52 and first and second plastic impregnated paper outer facings 56*a* and 56*b* adhered to opposed surfaces of the foam core. Disposed within the second panel's foam core 52 and respectively bonded to the panel's first and second outer facings 56*a*,56*b* are first and second metal reinforcing channels 42*a* and 42*b*. Attached to a lateral edge of the second structural insulated panel 38 is an edge cap 44 preferably comprised of metal which is affixed to the panel by conventional adhesive means. The metal edge cap 44 would be attached to a vertical edge of the second panel 38 such as when the first and second panels form a wall so as to define a doorway or window opening in the wall.

Adjacent edges of the first and second structural insulated panels 36,38 are securely connected together by means of first and second mastic strips 48*a* and 48*b*. Mastic strips 48*a*,48*b* are applied to the insulating core of either of the panels and the first and second structural insulate panels 36,38 are then placed in edge-abutting contact and the mastic strips are allowed to cure. First and second tape strips 46*a* and 46*b* each having a respective adhesive surface are then applied over the seams in the outer facings of the joined panels to form a vapor seal at the juncture of the two panels.

Figure 5:
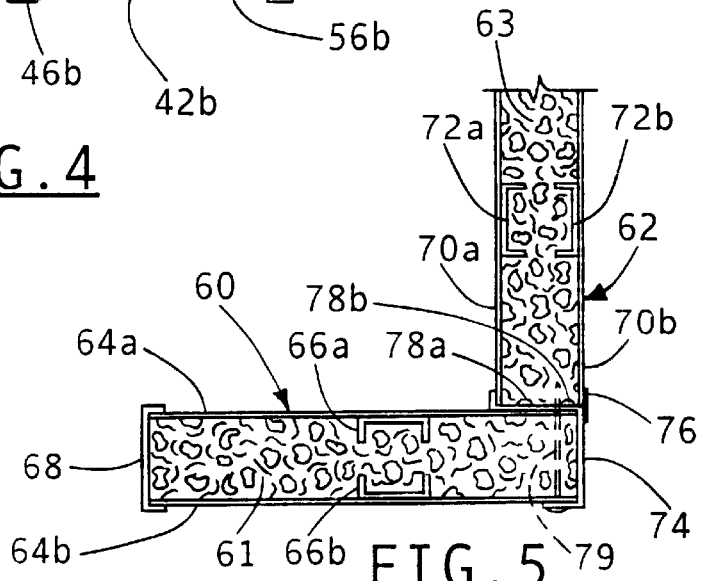
FIG. 5 is a partial top plan view of another embodiment of a pair of connected metal reinforced structural insulated panels in accordance with the present invention.

Referring to FIG. 5, there is shown partially in phantom a top plan view of another arrangement for securely connecting adjacent first and second structural insulated panels 60 and 62 forming adjacent wall sections in accordance with another aspect of the present invention. As in the previously described embodiments, the first structural panel 60 includes an insulating core 61 having facing surfaces to which are respectively bonded first and second outer facings 64*a* and 64*b*. Disposed within and attached to the insulating core 61 and affixed respectively to the first and second outer facings 64*a*,64*b* are first and second metal reinforcing channels 66*a* and 66*b*. Attached to a vertical edge of the first structural panel 60 by conventional adhesive means is a metal edge cap 68. The second structural panel 62 similarly includes an insulating core 63 having opposed surfaces to which are respectively attached first and second outer facings 70*a* and 70*b*. Disposed within and attached to the insulating core 63 and affixed respectively to the first and second outer facings 70*a*,70*b* are first and second metal reinforcing channels 72*a* and 72*b*.

Adjacent vertical edges of the first and second structural panels 60 and 62 are securely connected together in the following manner. A metal edge connecting channel 74 is configured so as to engage adjacent vertical edges of the first and second structural panels 60,62. Respective linear portions of the edge connecting channel 74 are positioned over each panel's foam core and extend between the opposed outer facings of the panel. Thus, a first linear portion of the edge connecting channel 74 extends between the first and second outer facings 64*a*,64*b* of the first structural panel 60 and covers the lateral edge of the panel's insulating core 61. A second linear portion of the edge connecting channel 74 extends between the second structural panel's first and second outer facings 70*a*,70*b* and covers the lateral edge of the panel's insulating core 63. First and second mastic strips 78*a* and 78*b* are deposited between the edge of the second structural panel's insulating core 63 and the edge connecting channel 74. The mastic strips 78*a*,78*b* form a secure bond of high strength between the first and second structural panels 60,62. A connecting pin 79 such as a screw (shown in dotted line form) is inserted through parallel, spaced portions of the edge connecting channel 74 as well as through the first structural panel's first and second outer facings 64*a*,64*b* and insulating core 61 and into the second panel's insulating core 63. The first and second mastic strips 78*a*,78*b* preferably extend the full length of each of the first and second structural panels 60,62. Similarly, additional connecting pins may be arranged in a spaced manner and inserted through the edge connecting channel 74 and the first structural panel 60 and into the second structural panel 62 for connecting the two panels along their respective lengths. An adhesive-backed tape 76 is positioned over the seam between the second structural panel's second outer facing 70*b* and the adjacent portion of the edge connecting channel 74 to form a vapor seal between the two panels.

Figure 6:
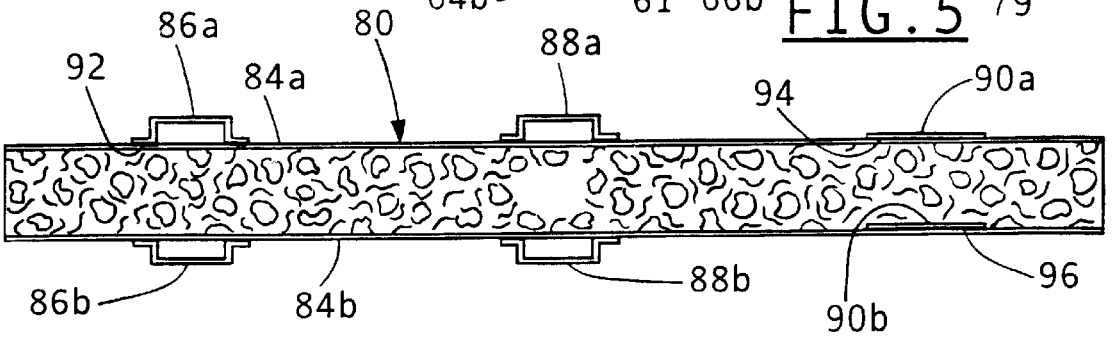
FIG. 6 is a top plan view of another embodiment of a structural insulated panel in accordance with the present invention showing the metal reinforcing members disposed on the outer surface of the panel's opposed facings.

Referring to FIG. 6, there is shown another embodiment of a structural insulated panel 80 in accordance with the present invention. Structural insulated panel 80 includes an insulating foam core 82 and first and second opposed plastic impregnated paper outer facings 84*a* and 84*b*. Affixed to the outer surfaces of each of the first and second outer facings 84*a*,84*b* are first and second pairs of metal reinforcing channels 86*a*,88*a* and 86*b*,88*b*, respectively. Each of the four metal by reinforcing channels is in the shape of a "hat" and is attached to the outer surface of a respective outer facing by means of an adhesive layer 92.

Structural insulated panel 80 is further shown in FIG. 6 as incorporating metal reinforcing members 90*a* and 90*b*. Each of the metal reinforcing members 90*a*,90*b* is in the form of a thin, flat strip. Metal reinforcing member 90*b* is bonded to the panel's insulating foam core 82 as well as to the inner surface of its second outer facing 84*b* by means of an adhesive layer 96. Similarly, metal reinforcing member 90*a* is affixed to the outer surface of the panel's first outer facing 84*a* by means of an adhesive layer 94. Metal reinforcing members extending the length of the panel may thus be in the form of a thin, flat strip of a metal such as steel or aluminum and may be bonded to either the inner or outer surfaces of either one or both of the panel's outer facings.

Figures 7, 9:
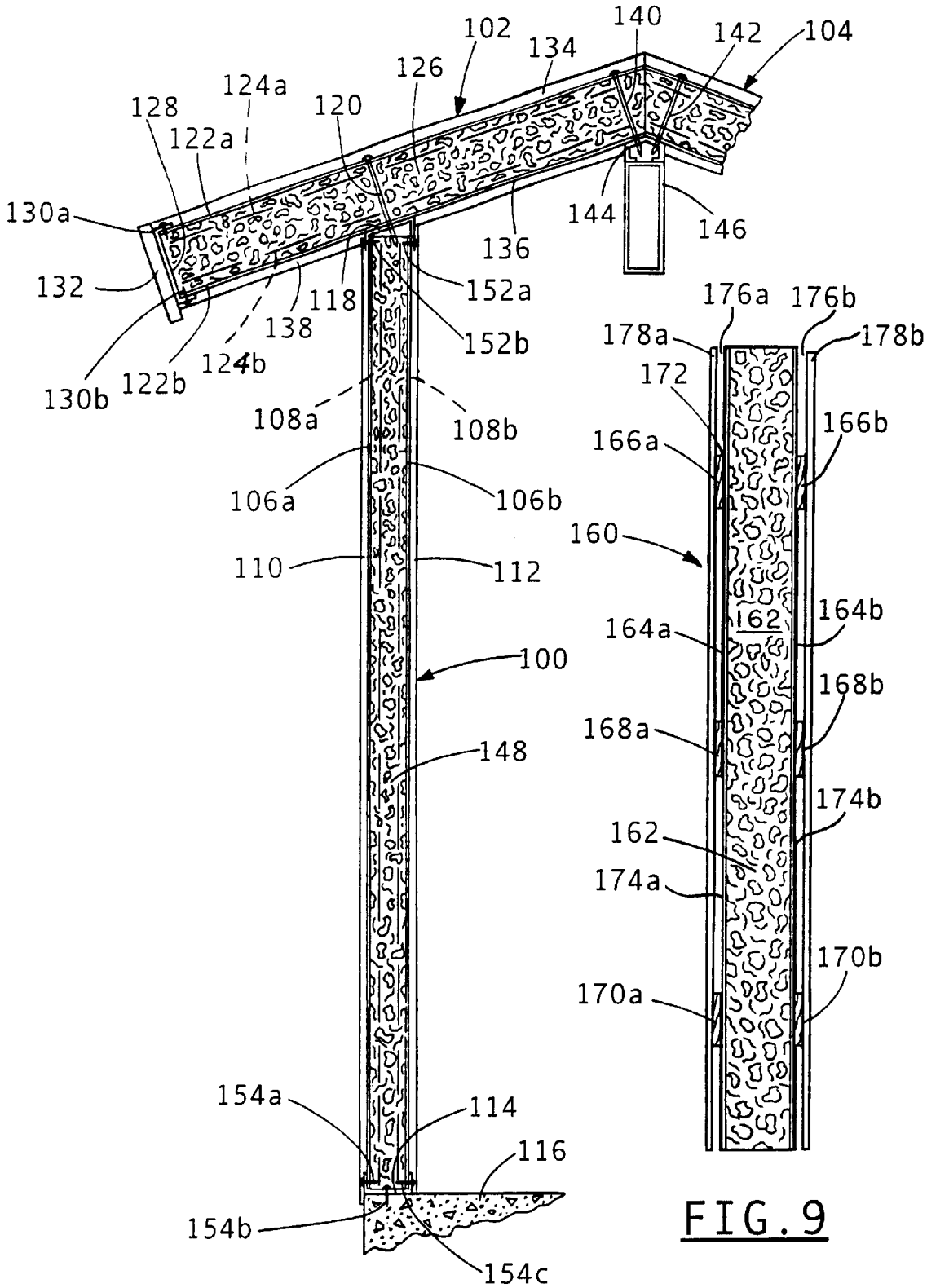
FIG. 7 is a side elevation view shown partially in phantom of a metal reinforced structural insulated panel attached at its lower end to a foundation or floor and at its upper end to a roof panel in accordance with another aspect of the present invention.
FIGS. 9 and 10 are top plan views of additional embodiments of the present invention incorporating reinforcing strips comprised of wood.

Referring to FIG. 7, there is shown a side elevation view shown partially in phantom of a metal reinforced structural insulated panel 100 attached at its lower end to a foundation or floor 116 and at its upper end to a roof panel 102 in accordance with another aspect of the present invention. Structural panel 100 is incorporated in a building structure as an exterior wall panel and, as in the previously described embodiments, includes first and second plastic impregnated paper outer facings 106*a* and 106*b* and an insulating core 148 disposed between and bonded to the two outer facings. Also disposed within the structural panel 100 and bonded to its insulating core 148 and its first and second outer facings 106*a*,106*b*, respectively, are first and second reinforcing members 108*a*,108*b* (shown in dotted line form). Each of the first and second reinforcing members 108*a*,108*b* may be either in the form of a flat strip or a shaped member such as a channel as previously described. Structural panel 100 typically would include several spaced reinforcing members adjacent its inner and outer surfaces. Attached to the panel's second outer facing 106*b* is an interior drywall sheet 112, while attached to the panel's first outer facing 106*a* is exterior siding 110. The drywall sheet 112 and the exterior siding 110 may be attached to respective facing portions of the structural panel 100 by conventional means such as nails or a high strength adhesive.

Attached to a lower end of the structural panel 100 is a base channel, or cap, 114. Base channel 114 is preferably comprised of a high strength metal and extends the full width of the structure panel 100. Base channel 114 is generally U-shaped and is adapted to receive the bottom edge of the structural panel 100 in a tight-fitting manner. Connecting pins 154*a* and 154*c* securely attach the base channel 114 to the lower end of the structural panel 100. A third connecting pin 154*b* is inserted through the base channel 114 and into the foundation 116 for securely mounting the lower end of the structural panel 100 to the foundation. Attached to the upper end of the structural panel 100 is a top channel 118 also preferably comprised of metal. Connecting pins 152*a* and 152*b* are inserted through respective lateral portions of the top channel 118 and into the upper end of the structural panel 100 for securely attaching the top channel to the upper end of the panel. The top channel 118 also extends the full width of the structural panel 100 and is used to connect a roof panel 102 to the upper end of the structural panel 100 by means of a plurality of spaced connecting pins 120. Each of the base and top channels 114,118 may also span one or more panels by being positioned on the lower or upper edges of several aligned panels. In this case, the base and top channels 114,118 may also be used to connect the adjacent panels by inserting connecting pins through the base and top channels and also through the lower and upper ends of each of the reinforcing members 108*a*,108*b* disposed within each of the panels.

Roof panel 102 is also configured in accordance with the present invention as it includes first and second plastic impregnated paper outer facings 122*a* and 122*b* and first and second reinforcing members 124*a* and 124*b* (shown in dotted line form). Roof panel 102 also includes an insulating foam core 126 as well as a metal end cap 128, preferably comprised of steel, attached by conventional means to an outer edge of the panel. Attached to the lower surface of the roof panel 102 by conventional means as previously described is interior drywall 136 as well as exterior soffit 138. With the structural panel 100 forming an exterior wall of a building structure, the interior drywall 136 is disposed within the building and the soffit 138 is disposed outside of the building. Positioned on and attached to the upper surface of the roof panel 102 is roofing 134, while attached to the outer edge of the roof panel is fascia 132. The plastic impregnated paper outer facings 122*a*, 122*b* provide the roof panel 102 with high tensile strength, while the first and second reinforcing members 124*a*,124*b* provide the roof panel with high resistance to bending.

Roof panel 102 is connected to a second roof panel 104 to form a roof peak. Supporting the joined edge portions of the first and second roof panels 102,104 is the combination of a roof beam cap 144 and a roof beam 146. First and second connecting pins 140 and 142 respectively inserted through the first and second roof panels 102,104 as well as through the roof beam cap 144 securely connect adjacent edges of the roof panels together as well as to the supporting roof beam 146. As shown in the exploded view of FIG. 8, mastic strips 156*a* and 156*b* are disposed between the roof beam cap 144 and each of the first and second roof panels

102,104. Similarly, mastic strips 158*a* and 158*b* are disposed between abutting edges of the first and second roof panels 102,104 at the peak of the roof. These mastic strips further increase the strength of the roof at its peak.

Referring to FIG. 9, there is shown another embodiment of a structural insulated panel 160 in accordance with the principles of the present invention. Structural panel 160 includes an insulating foam core 162 and first and second opposed outer facings 164*a* and 164*b* which are comprised of a plastic impregnated paper as previously described. Disposed on the outer surfaces of each of the first and second outer facings 164*a* and 164*b* are a plurality of spaced reinforcing strips which are each comprised of wood in this embodiment. Thus, reinforcing strips 166*a*,168*a* and 170*a* are affixed to the outer surface of the first outer facing 164*a* by means of an adhesive layer 172. Similarly, wooden reinforcing strips 166*b*,168*b* and 170*b* are affixed to the outer surface of the second outer facing 164*b* by means of a respective adhesive layer.

The structural insulated panel 160 shown in FIG. 9 also incorporates additional features relating to another embodiment of the invention. These additional features include first and second heat reflective layers 174*a* and 174*b* respectively disposed on and attached to the outer surfaces of the first and second outer facings 164*a* and 164*b*. These additional features further include a first drywall sheet 178*a* attached to the outer reinforcing strips 166*a*,168*a*,170*a* by conventional means such as an adhesive. Similarly, exterior siding 178*b* is attached to reinforcing strips 166*b*,168*b* and 170*b*. A first space, or gap, 176*a* is formed between the outer surface of the structural insulated panel 160 and the drywall sheet 178*a*. Similarly, a second space 176*b* is formed between the structural insulated panel 160 and the exterior siding 178*b*. Each of the reflective layers 174*a*,174*b* serves as a moisture barrier to prevent moisture from entering or passing through the panel and also reflects heat away from the structural insulated panel. Each of the spaces 176*a* and 176*b* formed between the structural insulated panel 160 and the drywall sheet 178*a* and exterior siding 178*b*, respectively, substantially increases the thermal insulating characteristics of the panel configuration shown in FIG. 9.

Figures 8, 10:
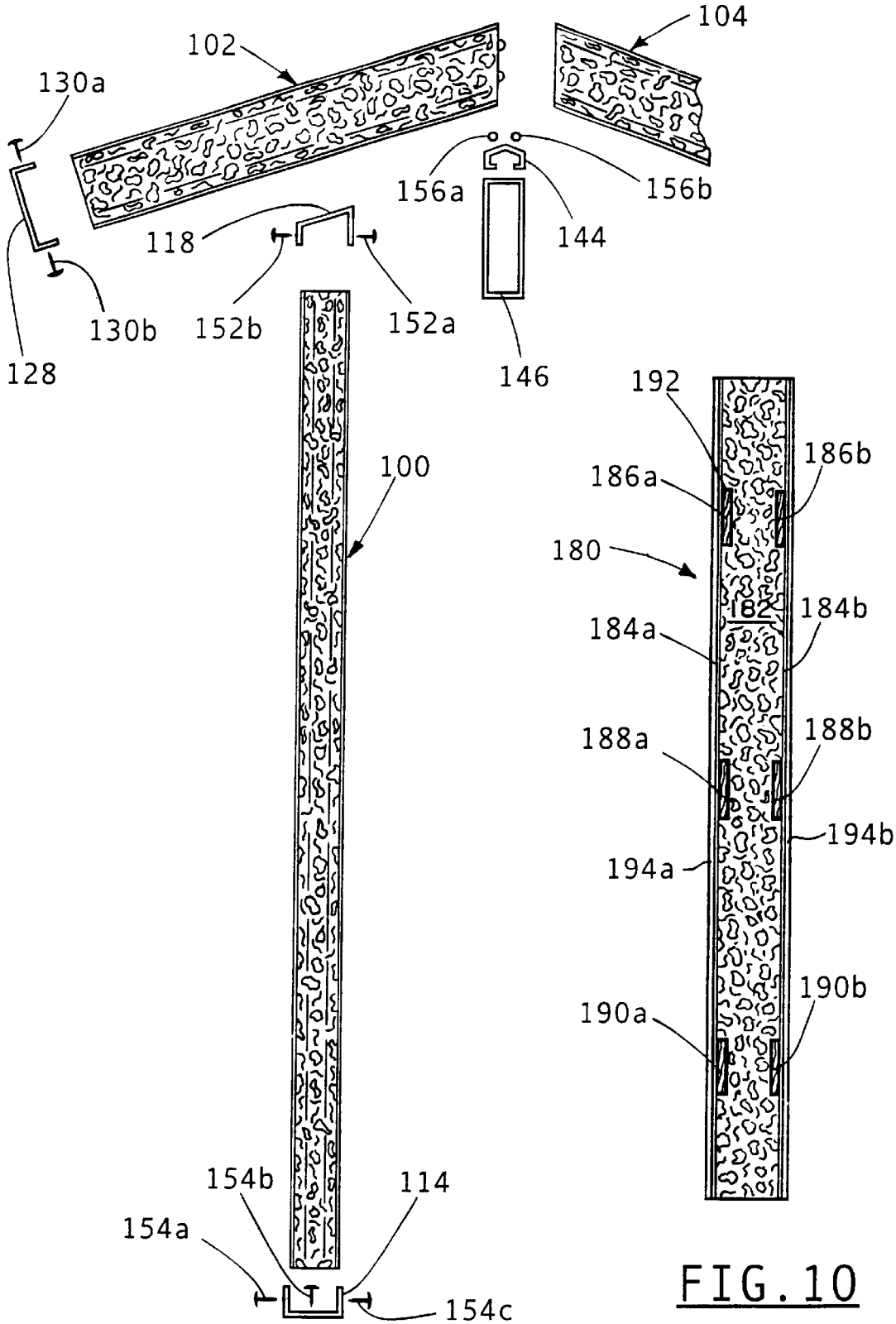
FIG. 8 is an exploded view of the metal reinforced structural insulated panel installation arrangement of FIG. 7.

Referring to FIG. 10, there is shown a top plan view of another embodiment of a structural insulated panel 180 in accordance with the present invention. As in the previously described embodiments, structural panel 180 includes an inner insulating core 182 and first and second opposed outer facings 184*a* and 184*b* which are comprised of a plastic impregnated paper. A first plurality of reinforcing strips 186*a*, 188*a* and 190*a* are disposed within the insulating core 182 and are in contact with the inner surface of the panel's first outer facing 184*a*. Each of the reinforcing strips has an adhesive coating 192 on its surface for bonding to the panel's insulating core 182 as well as to the inner surface of the first outer facing 184*a*. A second plurality of reinforcing strips 186*b*,188*b* and 190*b* are disposed in the opposed surface of the insulating core 182 and are in contact with the inner surface of the panel's second outer facing 184*b*. Each of the second plurality of reinforcing strips 186*b*, 188*b* and 190*b* is similarly provided with an adhesive coating for bonding to the panel's insulating core 182 as well as to the inner surface of the second outer facing 184*b*. Bonding of the reinforcing strips to both the panel's insulating core 182 and the first and second outer facings 184*a*,184*b* substantially increase the strength of the panel. As in the previously described embodiment, each of the reinforcing strips in structural panel 180 are preferably comprised of wood. Also in this embodiment of the invention, the first and second outer facings 184*a*, 184*b* of plastic impregnated paper are each provided with a respective reflective film 194*a*, 194*b* on its surface. The reflective films 194*a*,194*b* may be either metal-based such as of aluminum or may be comprised of a reflective plastic to provide a water vapor impervious barrier to prevent moisture from entering or passing through the structural panel 180.

Figure 11:
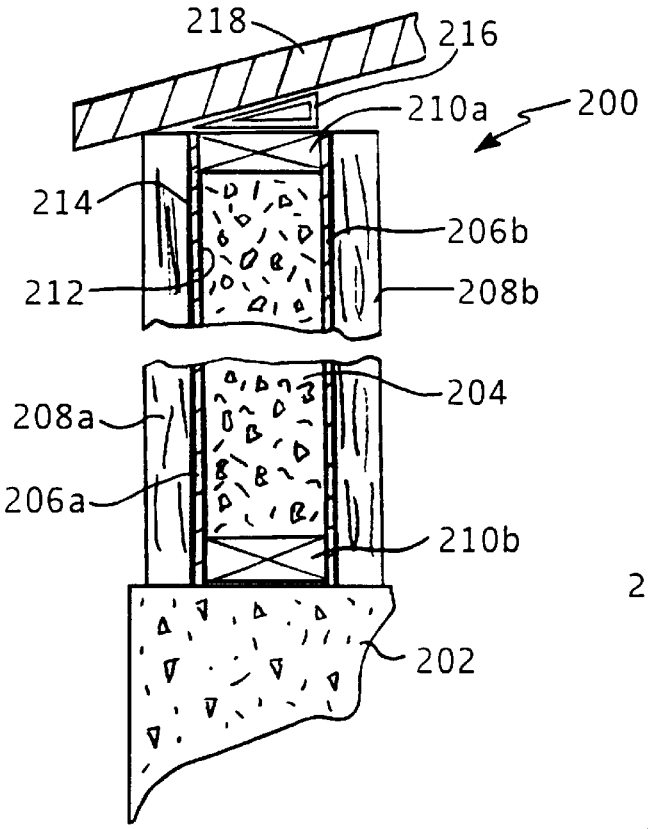
FIGS. 11 and 12 are sectional views of additional installations for a structural insulated panel in accordance with other aspects of the present invention.

Referring to FIG. 11, there is shown a partial sectional view of the installation of a structural insulated panel 200 in accordance with another aspect of the present invention. As in the previously described embodiments, structural insulated panel 200 includes an insulating foam core 204 and first and second plastic impregnated paper outer facings 206*a* and 206*b* attached to respective opposed surfaces of the foam core. Attached to the first outer facing 206*a* are a first plurality of spaced reinforcing members 208*a*, where only one reinforcing member is shown in the figure. Similarly, attached to the second outer facing 206*b* are a second plurality of spaced reinforcing members 208*b*. An inner surface of the first plastic impregnated paper outer facing 206*a* is attached to the panels' foam core 204 by means of a first inner adhesive layer 212. Similarly, an outer surface of the first plastic impregnated outer facing 206*a* is attached to the first reinforcing members 208*a* by means of a second outer adhesive layer 214. A similar connection arrangement is provided for the second outer facing 206*b*.

In accordance with this aspect of the invention, top and bottom plates 210*a* and 210*b* are respectively attached to upper and lower edge portions of the structural insulated panel 200. Each of the top and bottom plates 210*a*, 210*b* is comprised of a 2X lumber structural member. The top and bottom plates 210*a*, 210*b* may be attached to respective upper and lower edges of the structural insulated panel 200 by either an adhesive layer bonding the plates to the panels' foam core 204 and first and second outer facings 206*a*, 206*b* or by connecting pins which are not shown in the figure as they have been previously described. The top plate 210*a* facilitates attachment of the upper edge of the structural insulated panel 200 to a roof panel 218 by means of a top channel 216 and connecting pins such as nails or screws. Similarly, the bottom plate 210*b* attached to the lower edge of the structural insulated panel 200 facilitates mounting the panel to a foundation or floor 202.

Figure 12:
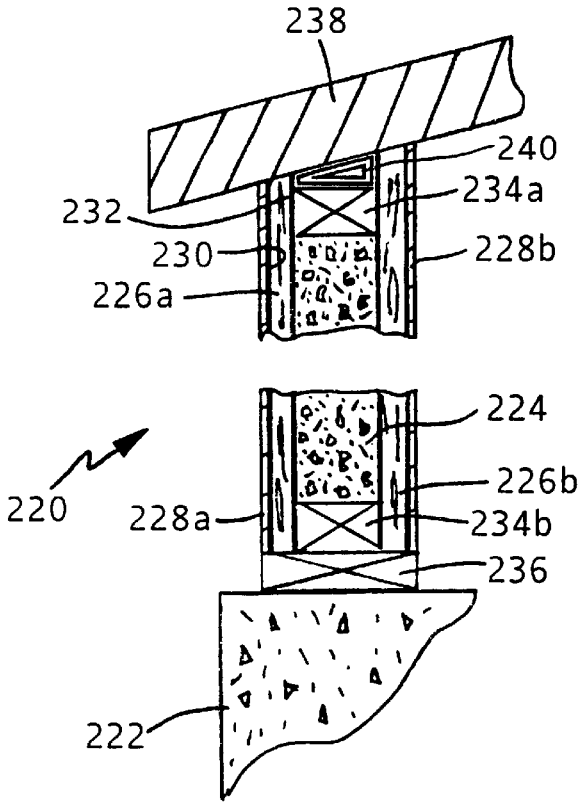

Referring to FIG. 12, there is shown a partial sectional view of another installation arrangement for a structural insulated panel 220 in accordance with another aspect of the present invention. Structural panel 220 includes a plastic foam insulating core 224 and first and second pluralities of reinforcing members 226*a* and 226*b* attached to opposed surfaces of the foam core. Attached to outer portions of each of the first plurality of reinforcing members 226*a* is a first plastic impregnated outer facing 228*a*. Similarly, attached to respective outer portions of each of the plurality of second reinforcing members 208*b* is a second plastic impregnated paper outer facing 206*b*. Inner portions of each of the first plurality of reinforcing members 226*a* are attached to the foam core 224 by means of an inner adhesive layer 232, while respective outer portions of each of the first reinforcing members is attached to the first plastic impregnated paper outer facing 228*a* by means of an outer adhesive layer 230. A similar attachment arrangement is provided for between the second reinforcing members 226*b* and the panels' foam core 224 and its second plastic impregnated paper outer facing 228*b*.

In accordance with this aspect of the invention, top and bottom plates 234*a* and 234*b* are respectively inserted in upper and lower grooves in the structural insulated panel

220 and are arranged in abutting contact with respective upper and lower edges of the panels' foam core 224. Each of the top and bottom plates 234*a*, 234*b* is attached to the panels' foam core 224 as well as to its first and second reinforcing members 226*a*, 226*b* by means of respective adhesive layers applied to the top and bottom plates. The top plate 234*a* facilitates attachment of the structural insulated panel 220 to a roof panel 238 by means of a top channel 240. Similarly, the bottom plate 234*b* facilitates attachment of a lower edge of the structural insulated panel 220 to a foundation or floor 222 by means of a base plate 236. The top and bottom plates 234*a*, 234*b* as well as the base plate 236 are preferably comprised by 2X structural lumber members. Suitable connecting pins such as nails or screws are used to connect the top and bottom plates 234*a*, 234*b* to the top channel 240 and roof panel 238 as well as to the base plate 236 and foundation 222, although these connecting pins are omitted from the FIG. 4 simplicity.

There has thus been shown a structural insulated panel for building construction having a planar, rigid insulating core with opposed surfaces to which are bonded respective plastic impregnated paper (PIP) sheets forming outer facings on the panel. The insulating core is preferably comprised of a lightweight, plastic foam. Elongated, linear structural reinforcing members are incorporated in the panel in a spaced manner either on the outer surfaces of the PIP outer facings, or on the inner surfaces of the facings and thus within the panel's insulating core. The reinforcing members may be in the form of a flat strip or a U-shaped channel along its length and may be comprised of thin sheet metal or wood. Conventional metals such as steel or aluminum may be used in the structural members to provide the panel with high bending strength. The PIP outer facings provide the panel with high tensile strength and bonding the reinforcing members to the panel's outer facings and, in some cases, to the insulating core further increases the structural strength of the panel. The metal reinforcing members may also be provided with an outer gypsum coating to protect the metal strip from heat and/or fire. The panels may be used in walls, roofs, or floors and may be connected together along adjacent abutting lateral edges by means of a conventional adhesive or by top and bottom edge channels extending between the adjacent panels and connected to the upper and lower edges of the structural members in each of the panels. Metal caps may be positioned on lateral edges of the panels adjacent openings in the panels such as a doorway or window. The reinforcing members are arranged in a spaced manner along the width of the panel and are also preferably arranged symmetrically with respect to the plane of the panel.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawing is offered by way of illustration only and not as a limitation. The actual scope of the invention is intended to be defined in the following claims when viewed in their proper perspective based on the prior art.

I claim:

1. A reinforced, insulated flat structural panel comprising:

a generally flat insulating core having first and second opposed sides;

first and second planar sheets of plastic impregnated paper respectively disposed on the first and second sides of said insulating core for providing the panel with high tensile strength;

first and second elongated, linear structural members respectively disposed in contact with said first and second sheets of plastic impregnated paper and extending substantially the entire length of the panel for increasing the bending strength of the panel and for attaching the panel to a support structure; and an adhesive disposed on said first and second structural members for respectively bonding said first and second structural members to said first and second sheets of plastic impregnated paper, wherein said first and second structural members are respectively in contact with an inner surface of said first and second sheets of plastic impregnated paper and are disposed entirely within and displaced inwardly from an edge of the panel, and wherein said adhesive further bonds said first and second structural members to said insulating core.

2. The panel of claim 1 further comprising a first plurality of first structural members and a second plurality of second structural members each respectively in contact with and bonded to said first and second sheets of plastic impregnated paper and to said insulating core.

3. The panel of claim 1 wherein said first and second structural members are disposed in contact with and bonded to an outer surface of said first and second sheets of plastic impregnated paper, respectively.

4. The panel of claim 3 further comprising a first plurality of first structural members and a second plurality of second structural members arranged in a spaced manner and each respectively in contact with and bonded to a respective outer surface of said first and second sheets of plastic impregnated paper.

5. The panel of claim 1 wherein said first and second structural members are formed from sheet metal.

6. The panel of claim 5 wherein said sheet metal is comprised of steel or aluminum.

7. The panel of claim 1 wherein said first and second structural members are comprised of wood or gypsum composites.

8. The panel of claim 1 wherein each of said first and second structural members is in the form of a flat, thin strip.

9. The panel of claim 1 wherein each of said first and second structural members is in the form of a generally U-shaped channel, an angle, or includes a projecting portion along its length.

10. The panel of claim 1 wherein said adhesive is a urethane or epoxy cement, glue or a mastic coating.

11. The panel of claim 1 wherein said insulating core is comprised of plastic foam.

12. The panel of claim 11 wherein said plastic foam is expanded polystyrene, urethane or polyisocyanurate.

13. The panel of claim 1 wherein said insulating core is an agricultural product such as strawboard.

14. The panel of claim 1 wherein said first and second sheets of paper are impregnated with urethane or polyisocyanurate.

15. The panel of claim 1 further comprising upper and lower caps respectively disposed on top and bottom edges of the panel and extending substantially the entire width of the panel and attaching means for securely attaching said upper and lower caps to the upper and lower edges of said first and second structural members, respectively.

16. The panel of claim 15 wherein each of said upper and lower caps is comprised of sheet metal.

17. The panel of claim 16 wherein each of said upper and lower caps is generally U-shaped and includes a recessed portion adapted to receive an edge of the panel in a tight-fitting manner.

18. The panel of claim 17 wherein said attaching means includes threaded connecting pins or an adhesive material.

19. The panel of claim 18 wherein each of said upper and lower caps extend to and engage top and bottom edges of a second, adjacent panel for connecting the top and bottom panel edges of the panels.

20. The panel of claim 1 further comprising a channel disposed on a lateral edge of the panel for engaging a lateral edge of an adjacent channel, said panel further comprising connecting pins inserted through said channel for connecting the panels along their respective lateral edges.

21. The panel of claim 19 or 20 wherein a seam is formed between the panels, said panel further comprising an adhesive-backed tape strip attached to said panels and disposed over said seam.

22. The panel of claim 1 further comprising adhesive disposed on an edge of the panel for connecting the panel to a second adjacent panel.

23. The panel of claim 20 wherein a seam is formed between the panels, said panel further comprising an adhesive-backed tape strip attached to said panels and disposed over said seam.

24. The panel of claim 1 further comprising a reflective layer disposed on at least one of said sheets of plastic impregnated paper.

25. The panel of claim 24 wherein said reflective layer is metal- or plastic-based.

26. The panel of claim 25 wherein said metal is aluminum.

27. The panel of claim 1 further comprising one or more electrical chases disposed in said insulating core for receiving electrical wiring.

28. The panel of claim 1 further comprising a sheet of gypsum or cementous composite attached to an outer surface of said first sheet of plastic impregnated paper.

29. The panel of claim 28 further comprising a sheet of exterior siding attached to an outer surface of said second sheet of plastic impregnated paper.

30. The panel of claim 15 further comprising first and second coupling means for respectively connecting said upper cap to a ceiling or roof member and said lower cap to a foundation or floor member.

31. The panel of claim 1 further comprising a layer of gypsum or cementous composite material disposed on said first and second structural members and under said adhesive means.

32. The structural panel of claim 1 further comprising first and second heat reflective layers respectively disposed on the outer surfaces of said first and second sheets of plastic impregnated paper.

33. The structural panel of claim 32 wherein said first and second structural members are attached to respective outer surfaces of said first and second sheets of plastic impregnated paper and are disposed over portions of said first and second heat reflective layers, respectively.

34. The structural panel of claim 33 further comprising a first flat panel attached to said first structural member so as to form a first insulating space between the structural panel and said first flat panel.

35. The structural panel of claim 34 further comprising a second flat panel attached to said second structural member so as to form a second insulating space between the structural panel and said second flat panel.

36. The structural panel of claim 35 wherein said first flat panel is a drywall sheet and said second flat panel is exterior siding.

37. The structural panel of claim 1 further comprising a top or a bottom plate respectively disposed over and in contact with upper or lower edges of said insulating core and between adjacent upper or lower edges of said first and second plastic impregnated papers sheets and structural members for attaching the panel to a support structure.

38. The structural panel of claim 37 wherein each of said top and bottom plates is comprised of 2x lumber.

39. The structural panel of claim 38 further comprising a base plate disposed on a lower edge of the structural panel and connected to said bottom plate for facilitating mounting the structural panel to a floor or foundation.

* * * * *